US006443383B1

(12) United States Patent
Stasny et al.

(10) Patent No.: US 6,443,383 B1
(45) Date of Patent: Sep. 3, 2002

(54) METHOD AND APPARATUS FOR UMBILICAL FLOATATION STORAGE

(76) Inventors: James Stasny, 16681 Windy Ryan Rd., College Station, TX (US) 77845; David Janac, 8165 County Rd. 244, Caldwell, TX (US) 77836; Dean Carey, 1713 Grey Stone, Bryan, TX (US) 77807

( * ) Notice: Subject to any disclaimer, the term of this patent is extended or adjusted under 35 U.S.C. 154(b) by 0 days.

(21) Appl. No.: 09/703,220

(22) Filed: Oct. 31, 2000

(51) Int. Cl.[7] ..... B65H 75/38
(52) U.S. Cl. ..... 242/388; 242/917
(58) Field of Search ..... 242/388, 917, 242/602, 602.1, 134.3 SR, 134.3 R; 254/134.3 SC, 134.3 R

(56) References Cited

U.S. PATENT DOCUMENTS 2,204,938 A * 6/1940 Le Bus ..... 242/117
3,576,295 A * 4/1971 Hale ..... 242/54
3,763,759 A * 10/1973 Ramsdale ..... 95/93
4,034,932 A * 7/1977 Ferch ..... 242/117
4,090,675 A * 5/1978 Betta ..... 242/47
4,217,066 A * 8/1980 Gunther ..... 405/185
4,477,036 A * 10/1984 Rundo ..... 242/67.2

OTHER PUBLICATIONS

International Ocean Systems Magazine article (Restrict Your Bend) Jul./Aug. 2000; vol. 4, No. 4.

* cited by examiner

*Primary Examiner*—Donald P. Walsh
*Assistant Examiner*—Mark J. Beauchaine
(74) *Attorney, Agent, or Firm*—McHale & Slavin

(57) ABSTRACT

In a system for recovery of marine ROVs, an umbilical is wound around a winch drum. A portion of the umbilical has foam floatation segments that may be damaged by wrapping about the drum. A flexible belt is inserted between the wrapped portion of the umbilical and the floatation segments to prevent damage to the floatation segments.

10 Claims, 3 Drawing Sheets

METHOD AND APPARATUS FOR UMBILICAL FLOATATION STORAGE

FIELD OF THE INVENTION

This invention relates to the field of marine remotely operated vehicles (ROV) and the connection between the surface ship and the ROV, referred to as an umbilical. The umbilical usually has a structural connection to the surface ship, in the form of a cable, and additional lines providing electrical power, video feed, command and control, and other functions, as needed.

BACKGROUND OF THE INVENTION

Remotely operated vehicles (ROV) are unmanned robotic submarines that operate at ocean depths up to 10,000 feet. ROVs are tethered to the mother ship by an umbilical for recovery and other functions. As the capabilities of ROVs increase, the size, horsepower and weight has increased which requires an umbilical of greater strength and weight. For example, 10,000 feet of umbilical will have an in water weight of 20,000 pounds. The umbilical weight is a problem for the operation of the ROV as it restricts mobility. To overcome this restricted mobility, the weight of the umbilical has been reduced by the use of floatation gear mounted along the umbilical.

High density foam floats clamped onto the umbilical have been used to compensate for the umbilical weight. The floats have been manually clamped onto the line at intervals of about 40 feet for the first 500 feet as the ROV is deployed to give the ROV a 500 feet radius of operation free of weight restriction. However, this process is very dangerous since the operators must reach over the side of the ship and, simultaneously, have control of the umbilical and manipulate a 60 pound air weight float to clamp it about the umbilical, as the umbilical is fed out. When the mission is completed and the ROV is recovered, these floats must be removed in the same manner before the umbilical is wound on the winch drum. In addition to the danger inherent in this process, there is usually no secure place to store the floats on the deck in close proximity to the operation. The clutter of floats fouls the deck and adds to the danger of the operation.

DESCRIPTION OF THE PRIOR ART

Recently, a continuous float system has been developed, such as shown in "International Ocean Systems Magazine," Vol. 4, No. 4, July/August 2000, which has cylindrical interlocking float segments that permit bending of the umbilical. The segments may be installed directly on the umbilical. Because of the cylindrical size of the segments the bend radius is approximately 1000 mm. The float segments may each be approximately 10 inches in diameter and about 12 inches long. The use of such a system eliminates the dangerous over the side work of the earlier systems.

However, the standard sheaves used to guide the umbilical will not accommodate this newer system of large diameter cylindrical floats. Further, winding the newer floats onto a winch drum damages the float segments. To avoid these problems, an umbilical with the newer floats is sometimes zig-zagged about several sheaves on the deck rather than being spooled onto a winch drum. This wastes extremely valuable deck space.

What the prior art lacks is an automated method for deployment and recovery of the umbilical, with the floats attached, by winding and unwinding from a winch drum.

SUMMARY OF THE INVENTION

This invention teaches a system and a method for its use wherein during recovery of marine ROVs, an umbilical which has foam floatation segments that may be damaged by wrapping about the drum, are safely wrapped thereon. A flexible belt, which may be segmented or in the form of a plurality of links, is provided which is inserted between the wrapped portion of the umbilical and the floatation segments to prevent damage to the floatation segments during storage upon the drum.

Accordingly, it is an objective of the instant invention to teach a method of deployment and recovery of a float equipped ROV umbilical about a winch drum.

It is a further objective of the instant invention to teach an apparatus for preventing damage to the floatation segments during deployment and recovery of a ROV umbilical.

It is yet another objective of the instant invention to teach a segmented or linked belt placed between spooled umbilical on a winch drum and floats being wound on the drum.

Other objects and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

DETAILED DESCRIPTION OF THE INVENTION

Figure 1:
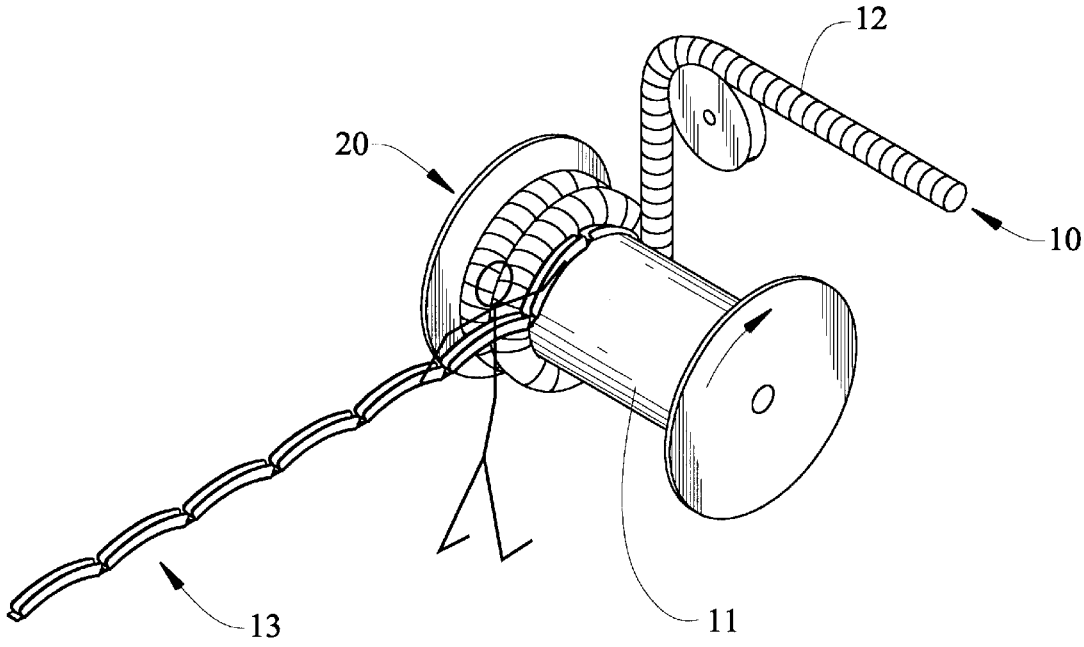
FIG. 1 shows a perspective of a portion of the device.

The winch drum 20 is mounted on the deck of a ship to which a ROV(not shown) is connected by umbilical 10. In FIG. 1, a portion 11 of the umbilical 10 is wound onto the drum 20 and the end portion 12 of the umbilical having the floatation segments is being recovered. As the floatation segments are wound around the drum, the belt 13 is placed between the spooled umbilical and the floatation segments. The belt 13 will continue to feed onto the drum because of the compression and rotation between the layers of the umbilical. The belt 13 forms a cradle which supports the circumference of the floatation segments on the drum 20. The cradle prevents the smaller diameter umbilical wraps already on the drum from being embedded in the larger softer diameter floatation segments.

Figure 2:
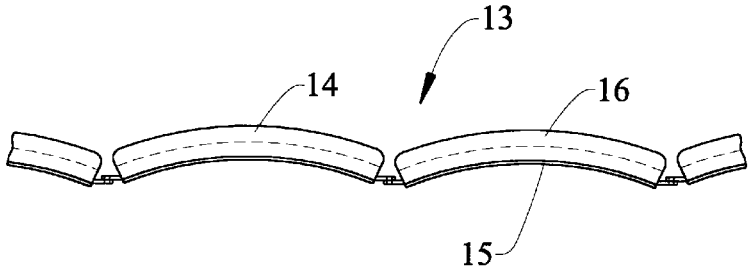
FIG. 2 shows a perspective of the belt.
Figure 3:
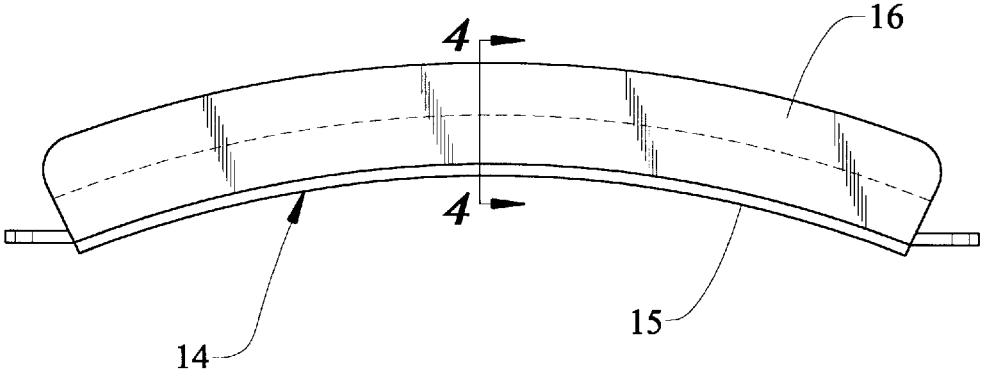
FIG. 3 shows a side view of a segment or link of the belt.

As shown in FIG. 2, the belt 13 is made up of longitudinally arched links or segments 14. The radius of each arch link approximates a segment of the circumference of the drum 20. The belt links 14, in FIG. 3, are composed of a backing 15 and a cushioning layer 16 joined by either adhesive or mechanical fasteners or both. The backing 15 may be of any strong flexible material, such as used in conveyor belts. The cushioning material may be a polymer plastic, such as polyurethane or light metals. As shown, the belt 13 is of a fixed length which will encompass 370 degrees of rotation about the drum. This requires a belt for each rotation of the drum. The 370 degrees of rotation establishes a staggered connection between belts as the drum rotates. However, the belt may have a longer or shorter length and may be continuous for the entire length of the drum.

Figure 4:
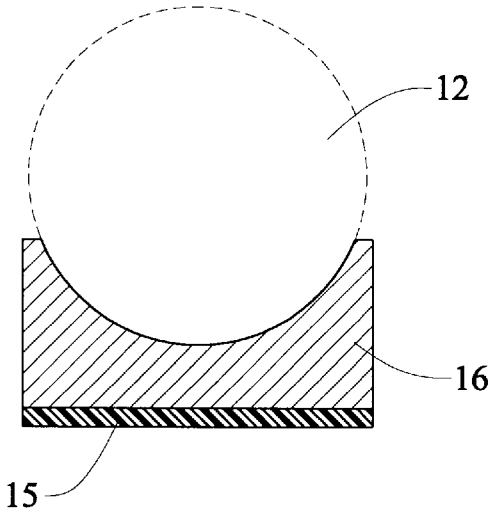
FIG. 4 shows a cross section along line 4—14 of FIG. 3.

The links 14 have a curved cross section, as shown in FIG. 4, which approximates the circumference of the floatation segment. This curved structure cooperates with the floatation segment to prevent the floatation segment from rolling off the belt and contacting the underlying wraps of the umbilical.

Figure 5:
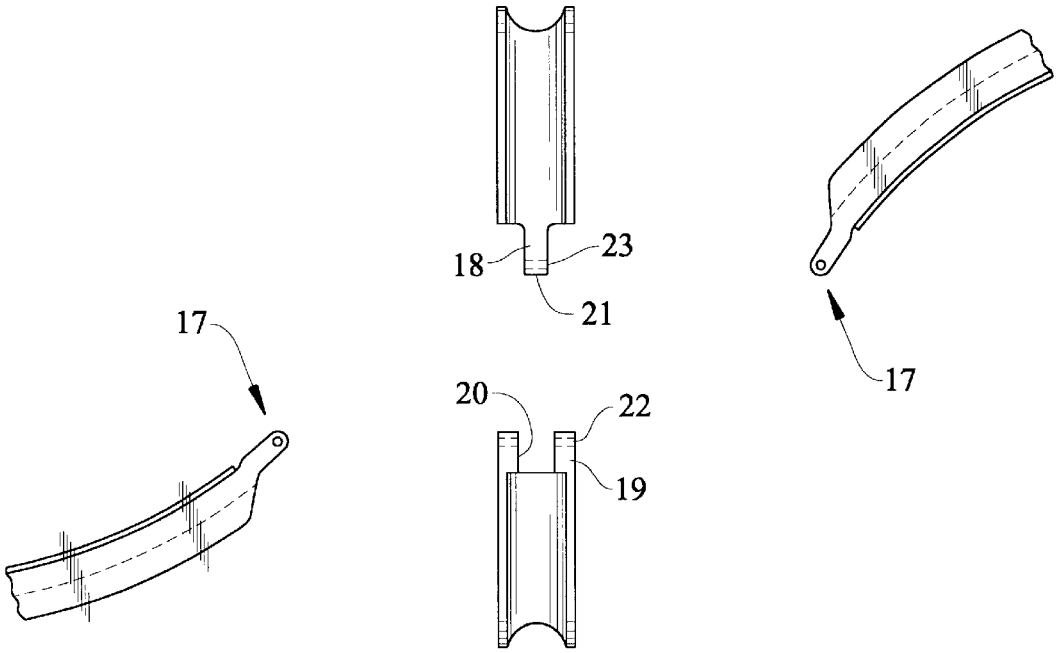
FIG. 5 shows a top view of the connection between linking segments of the belt.

The links 14 are connected together by a flexible joint that permits relative rotation between links. At the end of each belt there is a connector 17. As shown in FIG. 5, one end may have a male element 18 and the other end may have a female element 19. The male and female elements are designed for relative movement between belts, such as a clevis 20 and a tang 21. Both the clevis and tang have apertures 22 and 23, respectively, for a through-bolt (not shown) to rotatably connect them together. The flexible connection between belts may be an integral extension of the backing or in the nature of a ball and socket universal joint.

The use of the belt allows the floatation portion of the umbilical to be stored on the winch drum, without damage to the floatation segments, thereby saving deck space.

It is to be understood that while a certain form of the invention is illustrated, it is not to be limited to the specific form or arrangement of parts herein described and shown. It will be apparent to those skilled in the art that various changes may be made without departing from the scope of the invention and the invention is not to be considered limited to what is shown and described in the specification and drawings.

What is claimed is:

1. A method for preventing damage to floatation segments of an umbilical by underlying wraps on a winch drum comprising the steps of:

a) providing a flexible belt having a backing and a cushioning layer;

b) turning said winch drum to wind said umbilical onto said drum; and c) inserting said flexible belt between said floatation segments and underlying wraps of said umbilical.

2. A method of claim 1 further including the steps of:

d) attaching another flexible belt to said first belt after approximately one turn of said drum.

3. A method of claim 2 including the steps of e) staggering the attachments of said belts about the circumference of said drum.

4. A belt assembly for insertion between wraps about a winch drum, said belt assembly comprising a belt having a plurality of segments flexibly connected together, each of said segments having a backing layer and a cushion layer, each of said segments being longitudinally arched, each end of said belt having a connector means for rotatably attaching to another belt.

5. A belt assembly of claim 4 wherein each of said segments is transversely curved.

6. A belt assembly of claim 4 wherein said assembly comprises a plurality of belts, said plurality of belts connected by said connector means, said connector means on one end of one belt of said plurality of belts cooperating with said connector means on one end of another belt of said plurality of belts for rotation between said plurality of belts.

7. In a system for winding an umbilical on a winch drum wherein one portion of said umbilical has one diameter and a second portion has floatation segments attached thereto, said second portion having a greater diameter, said one portion wrapped about said drum, the improvement comprising a belt assembly having a length to extend at least once around said drum and wrapped portion, said belt assembly adapted to be placed between said one wrapped portion and said second portion, said belt assembly having a flexible backing and a plurality of cushion segments whereby said floatation segments are separated from said one wrapped portion of said umbilical.

8. In a system of claim 7 wherein said cushion segments are longitudinally arched.

9. In a system of claim 7 wherein said cushion segments are transversely curved.

10. In a system of claim 7 wherein a plurality of said belt assemblies are provided, each said belt assembly having a connector means on at least one end of said assembly for temporary rotatable connection to another of said plurality of belt assemblies.

* * * * *